US011103014B2

(12) United States Patent
Spiva

(10) Patent No.: US 11,103,014 B2
(45) Date of Patent: Aug. 31, 2021

(54) GARMENTS FOR LIFTING LOOSE SKIN AND METHODS FOR USING SAME

(71) Applicant: Mary Spiva, Atlanta, GA (US)

(72) Inventor: Mary Spiva, Atlanta, GA (US)

( * ) Notice: Subject to any disclaimer, the term of this patent is extended or adjusted under 35 U.S.C. 154(b) by 326 days.

(21) Appl. No.: 16/140,118

(22) Filed: Sep. 24, 2018

(65) Prior Publication Data

US 2019/0090553 A1 Mar. 28, 2019

Related U.S. Application Data

(60) Provisional application No. 62/561,753, filed on Sep. 22, 2017, provisional application No. 62/588,796, filed on Nov. 20, 2017.

(51) Int. Cl.
*A41C 1/00* (2006.01)
*A41B 9/14* (2006.01)

(52) U.S. Cl.
CPC ..... *A41C 1/003* (2013.01); *A41B 9/14* (2013.01); *A41B 2400/38* (2013.01)

(58) Field of Classification Search
CPC .. A41C 1/08; A41C 1/003; A41C 1/10; A41B 9/14; A41B 2400/38
USPC ..... 450/155, 106, 112
See application file for complete search history.

(56) References Cited

U.S. PATENT DOCUMENTS 1,033,957 A * 7/1912 Scultz ..... A41C 1/10 450/155
3,524,449 A * 8/1970 Peters ..... A41C 1/00 450/100
5,267,928 A * 12/1993 Barile ..... A63B 21/4025 2/228
5,784,723 A * 7/1998 Noble ..... A41C 1/003 2/228
6,058,514 A * 5/2000 Hart ..... A41B 9/001 2/406
7,081,036 B1 * 7/2006 Howard ..... A41C 1/00 450/100
7,260,961 B1 * 8/2007 Kennedy ..... D04B 1/243 66/171
7,341,500 B2 3/2008 Horn et al.
7,908,674 B2 3/2011 Jones
8,826,465 B2 9/2014 Greenblat
10,258,131 B2 * 4/2019 Yim ..... A45C 13/24
10,638,798 B2 * 5/2020 Glaude ..... A41F 9/025
10,660,374 B2 * 5/2020 Glaude ..... A41B 9/14
10,834,975 B2 * 11/2020 Heisser ..... A41B 9/001
2002/0007507 A1 * 1/2002 Duran ..... A41B 11/003 2/406
2013/0344772 A1 * 12/2013 Fruscione-Loizides ..... A41C 1/10 450/95

(Continued)

*Primary Examiner* — Gloria M Hale
(74) *Attorney, Agent, or Firm* — Bekiares Eliezer LLP

(57) ABSTRACT

Disclosed herein are garments for lifting and concealing loose and/or saggy skin and methods for using the same. In one aspect, the garment includes at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a portion of a wearer's body. Also disclosed herein are methods for using the disclosed garments.

20 Claims, 3 Drawing Sheets

(56) References Cited

U.S. PATENT DOCUMENTS

| | | | | |
|---|---|---|---|---|
| 2016/0361190 | A1 | 12/2016 | Caden et al. | |
| 2018/0177245 | A1* | 6/2018 | Glaude | A41C 1/08 |
| 2018/0289077 | A1* | 10/2018 | Glaude | A41C 1/08 |

* cited by examiner

GARMENTS FOR LIFTING LOOSE SKIN AND METHODS FOR USING SAME

CROSS REFERENCE TO RELATED APPLICATIONS

The present application claims the benefit of priority to U.S. Provisional Patent Application Ser. No. 62/561,753, filed Sep. 22, 2017, and U.S. Provisional Patent Application Ser. No. 62/588,796, filed Nov. 20, 2017, which are hereby incorporated herein by reference in their entireties.

FIELD OF DISCLOSURE

The present disclosure relates to garments for lifting and concealing loose and/or saggy skin, articles of clothing and methods for using the same. More specifically, various embodiments of the present disclosure relate to undergarments and shapewear for lifting and smoothing loose and/or saggy skin.

BACKGROUND OF THE INVENTION

As women and men age, or gain and lose weight, skin in various portions of the body may sag, dimple, and otherwise lose its smooth, uniform appearance. This abnormal, unsightly loose skin typically collects and droops in body areas such as the thighs above the knees and calves above the ankles, arms under the bicep and below the elbow, and the like. Aside from surgical intervention, there are few effective options to reverse the effects that aging, genetics, or weight loss has on skin.

Currently, the only non-surgical options to address loose skin are to cover or hide it completely behind a layer of clothing, or to use cumbersome, painful tape products applied directly onto to the skin under clothing to pull it upward. However, simply hiding saggy skin forces an individual to wear garments that reach longer on the body than may be desired for body temperature, fashion or seasonality reasons. There are no garment solutions that feasibly, efficiently, effortlessly and comfortably upwardly lift saggy skin, for example, in the leg and arm areas, using a graduated, varied and adjustable technique.

Accordingly, there remains a need for new garment solutions that, when worn under clothing or alone, can lift saggy and loose skin and give adjacent skin the appearance of firm, smooth, and tight skin. This need and other needs are satisfied by the various aspects of the present disclosure.

SUMMARY OF THE INVENTION

In accordance with the purposes of the invention, as embodied and broadly described herein, the invention, in one aspect, relates to garments for lifting and/or concealing by elongating or flattening areas not covered by clothing where loose or saggy skin would otherwise be visible, such as on the upper thigh and upper arm.

In an exemplary aspect, the invention relates to a garment for lifting saggy skin, the garment comprising at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a first portion of a wearer's body.

In another exemplary aspect, the invention relates to a garment for lifting loose skin, the garment comprising at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to at least one portion of a wearer's body; and at least one band first and second opposed ends, each band connected at one or more connection points to at least one portion of a surface of at least one support panel of the plurality of support panels and circumferentially disposed on a plurality of support panels.

In another exemplary aspect, the invention relates to a garment for lifting loose skin, the garment comprising at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to a first portion of a wearer's body; and a plurality of bands, each band having first and second opposed ends, each band connected at one or more connection points to at least one portion of a surface of at least one support panel of the plurality of support panels.

In another exemplary aspect, the invention relates to a method for lifting loose skin using a garment, the method comprising the steps of: a) providing a disclosed garment; and b) placing a portion of the garment on a wearer's body to hold up loose and saggy skin, thus giving a smooth, tight and firm appearance.

In further aspects, the invention also relates to articles of clothing and methods for using the disclosed garments and devices.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1A:
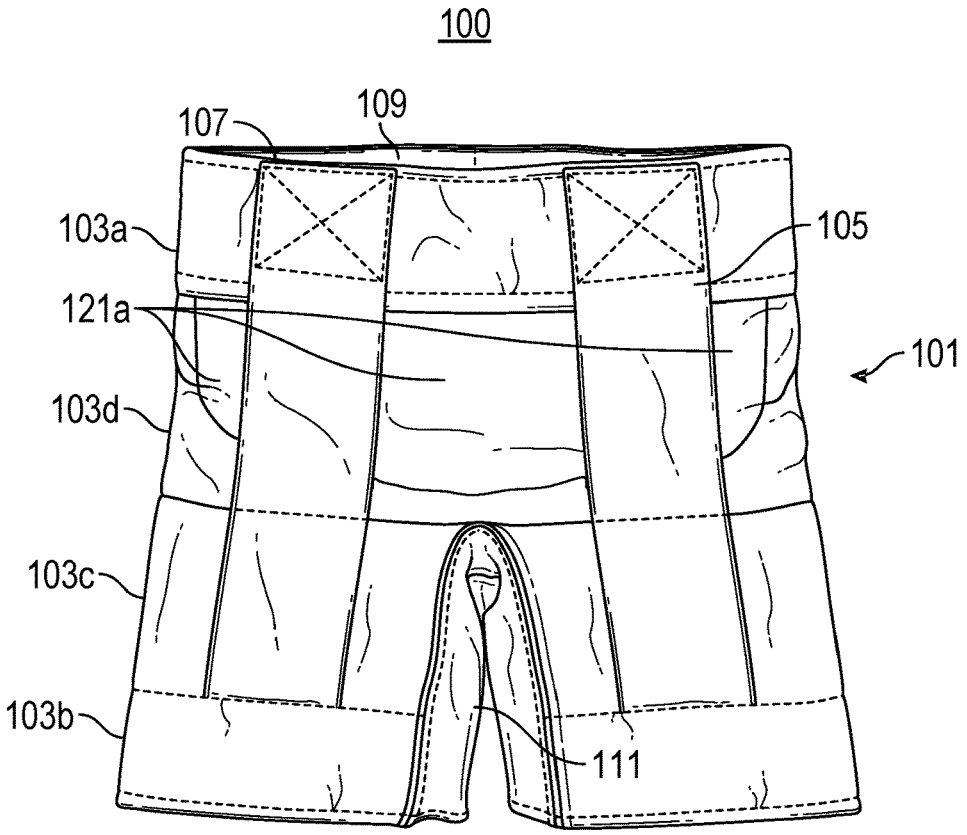
FIGS. 1A-1B show various views depicting a garment in accordance with an exemplary embodiment of the present invention.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "a band" includes two or more bands.

Ranges can be expressed herein as from one particular value, and/or to another particular value. For example, such ranges can include varying fiber combinations and compression intensities. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Disclosed are the components to be used to manufacture the disclosed devices and articles of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. Garments and Methods for Use Same

As briefly described above, the present disclosure relates, in various aspects, to garments for concealing saggy skin, such as by pulling loose skin into the garment to create the appearance of firm, smooth and tight skin in the adjacent area not covered by the garment.

In further aspects, exemplary garments of the present invention may comprise, or otherwise take the form of undergarments, shapewear, activewear, athleisure, such as, and without limitation, shorts, tights, yoga pants, leggings, sleeves, tennis skirts, golf skirts, shorts or any other type of garment that may be worn on a portion of body where upward lift and uniform distribution of loose or excess skin is desired. In still further aspects, the garments can accommodate persons of any age, size, gender, or levels of loose skin, and still allow an individual to wear form fitting and revealing fashions such as shorts, short skirts, dresses, and the like.

In some embodiments, the garment may be comprised of water-resistant or waterproof material such that the garment can be worn in with bathing suits, bikinis, one-piece bathing suits, tankinis, and bathing suit skirts. In other embodiments, the disclosed garments may be used with a bathing suit coverup.

In one aspect, the present disclosure provides a garment for lifting loose skin, such as for example, in the upper thigh area. In further aspects, the garment may be configured to be worn and lift loose skin on other parts of the body, such as, and without limitation, the back thigh, stomach and upper arm area, ankle and face area. In still further aspects, the garment is configured to secure around a circumference of at least one portion of wearer's body when the garment is worn.

In various aspects, the garment may comprise a garment support portion configured to lift and hold a wearer's loose skin, the support portion comprising: a plurality of support panels, each support panel having an interior surface and exterior surface, a first edge defining a first opening and second edge defining a second opening, the support panel being configured to adjustably secure the support portion to a first portion of a wearer's body.

In further aspects, the garment may comprise at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a first portion of a wearer's body. In still further aspects, the garment may further comprise at least one band or strap having first and second opposed ends, each band or strap attached or connected at one or more connection points to at least one portion of a surface of at least one support panel of the plurality of support panels. In some aspects, the at least one band may be connected to an exterior surface of at least one support panel of the plurality of support panels. In other aspects, the at least one band may be connected to an interior surface of at least one support panel of the plurality of support panels.

In further aspects, the garment may comprise various configurations and shapes. In still further aspects, a support panel, outer panel, and/or outer garment body can have a substantially tubular or cylindrical shape, having first and seconds openings, for example, that would allow a user to insert various body parts into and/or substantially cover a user's body part. In yet further aspects, a support panel may comprise a top support panel configured to flexibly secure around a second portion of the wearer's body. In even further aspects, a support panel may comprise a bottom support panel configured to flexibly secure around a third portion of the wearer's body. In still further aspects, a support panel may comprise a middle support panel configured to flexibly secure around a fourth portion of the wearer's body. In yet further aspects, a support panel may comprise a middle support panel configured to flexibly secure around a fifth portion of the wearer's body. In some aspects, a support panel may comprise a first middle support panel configured to flexibly secure around a fourth portion of the wearer's body, and at least one support panel may comprise a second middle support panel configured to flexibly secure around a fifth portion of the wearer's body.

In further aspects, a support panel may comprise a top support panel configured to flexibly secure around a portion of the wearer's waist. In still further aspects, a support panel may comprise a bottom support panel configured to flexibly secure around a first portion of the wearer's thigh. In yet further aspects, a plurality of support panels may comprise a first bottom support panel configured to flexibly secure around a first portion of the wearer's first thigh and a second bottom support panel configured to flexibly secure around a first portion of the wearer's second thigh. In still further aspects, a support panel may comprise at least one middle support panel configured to flexibly secure around a second portion of the wearer's thigh. In even further aspects, a support panel may comprise at least one middle support panel configured to flexibly secure around a portion of the wearer's stomach and/or butt area. In some aspects, a plurality of support panels may comprise at least one lower middle support panel configured to flexibly secure around a portion of the wearer's upper thigh, and at least one upper middle support panel configured to flexibly secure around a portion of the wearer's stomach. In other aspects, a plurality of support panels may comprise first and second lower middle support panel configured to flexibly secure around portions of the wearer's first and second upper thighs respectively, and at least one upper middle support panel configured to flexibly secure around a portion of the wearer's stomach.

In further aspects, the top support panel may be connected or attached to at least one other support panel. In still further aspects, a first edge of at least one support panel and a second edge of a top support panel may be connected or attached. In yet further aspects, the garment may further comprise a plurality of bands. In even further aspects, at least one end of a band may be attached or connected to at least one support panel. In still further aspects, a first end and a second end of the band may be attached or connected to different support panels. In yet further aspects, a first end, a second end, and middle portion of the band are attached or connected to different support panels. In some aspects, a first end of the band may be attached or connected to at least one support panel, and a second opposed end of the band may be attached or connected to at least one other support panel. In other aspects, a first end of the band may be attached or connected to a first support panel, a second opposed end of the band may be attached or connected to a second support panel, and middle portion of the band may be attached or connected to a third support panel. In further aspects, a band may be circumferentially disposed on a plurality of support panels. In some aspects, a band may be circumferentially disposed on a top support panel and a middle support panel. In other aspects, a band may be circumferentially disposed on a top support panel and an upper middle support panel.

In various aspects, the garment support portion and/or support panels may comprise a plurality of compression zones. In further aspects, the plurality of compression zones may provide varying amounts of compression along the garment, and thus, along the corresponding portion of a wearer's body it is secured against. In still further aspects, the plurality of compression zones may comprise a graduated distribution of compression zones. In yet further aspects, together, each of the plurality of compression zones can provide graduated levels of compressive force in order to exert an upward lift of loose or saggy skin.

According to various embodiments of the present disclosure, adjacent compression zones should provide a compressive force effective to allow for at least a portion of the loose or saggy skin to be pushed in an upward fashion. To this end, if any particular compression zone provides too high of a compressive force, it may cause the garment to exert an excessive inward compressive force on that portion of the body, thus preventing the uplifting action for even distribution of loose skin. In some aspects, the compressive force exerted by the first compression zone and subsequent compression zones may vary quite drastically, for example to ensure the exposed skin maintains a smooth, firm and tight appearance. In other aspects, the compressive force exerted by the compression zones may vary gradually between compression zones. In further aspects, the garment may provide varying amounts of compression along a portion of the wearer body with the maximum amount of compressive force provided at the portion of the body where the loose skin is first pulled up, to a minimum compression force towards the trunk or core of the wearer's body.

The compressive force needed for each compression zone along the garment to achieve the desired compression gradient to evenly lift up the saggy skin may be determined based upon body anatomy and the amount of excess or loose skin of the wearer. For example, the garment may comprise a first compression zone providing at least about 40 mmHg, a subsequent compression zone providing less than 40 to about 30 mmHg, a subsequent compression zone providing less than 30 to about 20 mmHg, a subsequent compression zone providing less than 20 to about 10 mmHg, and the like.

In further aspects, the garment may comprise connecting segment configured to couple adjacent support panels or compression zones along one or more areas of the garment. In still further aspects, the top support panel and other support panels may be connected, for example, where the other support panels and the top support panel are mechanically connected or attached. In still further aspects, the first edge of a support panel and the second edge of the top support panel may be connected or attached. In some aspects, at least one end of a strap or band may be attached or connected to the top support panel, or a combination thereof. In other aspects, one end of a strap or band may be attached or connected to the top support panel and the opposed end is attached or connected to a lower support panel. In further aspects, one end of the strap or band may be attached or connected to a front, side and/or rear portion of the top support portion and the other strap end may be attached or connected to the front, side and/or rear portion of the one or more lower support panels. In still further aspects, the strap or band may be comprised of an elastic material configured to be flexibly secured against a portion of a wearer's body. In some aspects, the top and/or bottom support panel may also be comprised of an elastic material or band configured to flexibly secure an opening of the garment against a portion of a wearer's body.

In further aspects, at least one support panel may define an outermost opening and/or edge of the garment. In still further aspects, a top support panel defines an outermost opening and/or edge of the garment. In yet aspects, a bottom support panel defines an outermost opening and/or edge of the garment. In some aspects, a top support panel defines a first outermost opening and/or edge of the garment, and a bottom support panel defines an opposed, second outermost opening and/or edge of the garment.

In further aspects, a support panel may comprise at least one of an outer panel having an interior surface and exterior surface, or an inner panel having an interior surface and exterior surface. In yet further aspects, a support panel may comprise an outer panel having an interior surface and exterior surface and an inner panel having an interior surface and exterior surface. In still further aspects, a support panel may comprise at least one of an outer layer having an interior surface and exterior surface, or an inner layer having an interior surface and exterior surface. In even further aspects, a support panel may comprise an outer layer having an interior surface and exterior surface and an inner layer having an interior surface and exterior surface.

In further aspects, a band or strap may be disposed between an outer panel and inner panel of at least one support panel. In yet further aspects, a strap or band may be disposed between an outer panel and inner panel of a plurality of support panels. In still further aspects, a strap or band may be disposed between an outer layer and inner layer of at least one support panel. In even further aspects, a strap or band may be disposed between an outer layer and inner layer of a plurality of support panels.

In further aspects, the garment may further comprise one or more relief panels, for example, a gusset, configured to provide breadth and/or reduce stress from at least one portion of the garment. In yet further aspects, a relief panel may be connected to at least one portion of at least one support panel, and the relief panel may be configured to provide breadth and/or reduce stress from at least one portion of the wearer's body. In still further aspects, a relief panel may be connected to at least one portion of at least one support panel, and may be configured to provide breadth and/or reduce stress from a corresponding portion of the wearer's body the at least one support panel is configured to secure against. In even further aspects, a relief panel is connected to at least one portion of at least one bottom support panel, and may be configured to provide breadth and/or reduce stress from a portion of the wearer's crotch area. In yet further aspects, a relief panel may be connected to at least one portion of at least one middle support panel, and may be configured to provide breadth and/or reduce stress from a portion of the wearer's crotch area. In yet further aspects, a relief panel may be connected to at least one portion of at least one middle support panel and one bottom support panel, and wherein the at least one relief panel is configured to provide breadth and/or reduce stress from a portion of the wearer's crotch area. In some aspects, a relief panel may be configured to provide from about 1 to about 5 inches additional breadth. In other aspects, a relief panel may be configured to provide from about 0.25 to about 0.5 inch additional breadth. In yet other aspects, a relief panel may be configured to provide from about 0.5 to about 2.5 inches additional breadth. In still other aspects, a relief panel may be configured to provide from about 1.0 to about 1.5 inches additional breadth.

As described above, garments of the present invention may comprise single or multiple layer construction. In some aspects, the garment may comprise single layer construction where graduation in compressive force may be achieved by, for example, by varying the thickness of the material in each compression zone. In this aspect, each compression zones on the garment may have a different thickness, while the garment can retain a substantially uniform external and/or internal appearance. In further aspects, the graduation in compressive force can be achieved by varying the type or composition of the material for each compression zone.

In other aspects, the garment may comprise multi-layer construction. In some aspects where graduation in compressive force may be achieved by, for example, internal layers or support panels having varying compression zones. In further aspects, an outer panel, outer garment body, and/or support panels may be integrated and take the form of a two-ply construction in the portions where they are attached or overlap. In further aspects, a top support panel may further comprise at least one attachment means configured to detachably connect the top support panel to one or more garment portions or components. In still further aspects, the attachment means may be disposed on one more portions of the top support panel. In yet further aspects, at least one portion of a support panel may be configured to attach to a top portion of the top support panel. In some aspects, the top support panel comprises a reinforced band having a plurality of attachment means configured to connect to other support panels to allow for adjustment of the level of loose skin support. In other aspects, a top support panel may comprise a reinforced top band having a plurality of attachment means configured to connect to the support panels, wherein a first edge of the support panel is attached to an inner surface of an outer panel and a second edge of the support panel is attached to a plurality of straps or band configured to connect to the plurality of attachment means disposed on the top support panel. In still other aspects, the second edge of the support panel may be attached to an inner front surface of an outer panel or outer garment body and attached to a plurality of straps configured to connect to the plurality of attachment means disposed on the front portion of top band.

In further aspects, the attachment means comprises buttons, hooks, snaps, fasteners, VELCRO, silicone, ruching strips, or the like, or combinations thereof. In still further aspects, the garment is configured to slide on and off like standard under garment. In even further aspects, the support panel may comprise thick elastic bands, or the like. In some aspects, the garment may be constructed as a one-piece undergarment and configured to hold up loose skin, for example, on the upper thighs and other parts of the body as described herein. In other aspects, the garment support portion may comprise a clear, elastic-type band configured to roll up a wearer's arm, or incorporated in to a shirt, such as in the sleeve on the sleeve, thereby providing a firm, smooth appearance of the arm. In further aspects, the garment may be configured to be able to be worn under short sleeve dresses and shirts. In some aspects, the garment may be configured to fit men and women. In other aspects, the garment may be unisex. In some aspects, the garment may be worn as a bra with a band to hold up the loose skin in the stomach area, as a band to hold up the loose skin the ankle area or as a head band to hold up loose skin the facial area.

In some aspects, the top support panel or other support panels can comprise a channel, the channel being formed at an outer most edge of the garment. In further aspects, a band may be located within the channel, the band being configured to be flexibly drawn in the corresponding portion of the garment or garment opening. In still further aspects, the channel and or band can be comprised of an elastic material configured to flexibly close the opening, for example, to releasably secure that portion of the garment to a wearer's body. In some aspects, there may be a collar about the garment opening, the collar made of an elastic material. In further aspects, the garment may comprise one or more closure means. In still further aspects, the closure means may define an outermost edge of the garment. In yet further aspects, the closure means may comprise a strap, cord, cord or strap lock, zipper, buttons, snaps, clips, hooks, VELCRO, fasteners, silicone, ruching strips and combinations thereof.

In various aspects, the garment may comprise a plurality of materials. In further aspects, the garment may comprise soft, breathable material. In even further aspects, the material can comprise a fabric, laminated material, film, sheet, coated fabric, or combinations thereof. In still further aspects, the fabric may comprise a woven fabric, non-woven fabric, natural fabric, synthetic fabric, or combinations thereof. In even further aspects, the material may comprise latex, LYCRA, nylon, spandex, elastane, polyester, lace, silk and/or cotton, or a combination thereof. In yet further aspects, the undergarment may be hand or machine washable and allow stretch and recovery. In still further aspects, the material may comprise varying fiber combinations and compression intensities. In yet further aspects, the material can comprise a thermoplastic material, thermoplastic sheet or fabric material or a waterproof material such as neoprene, nylon, polypropylene, polyurethane, silicone, vinyl plastic or the like. In some aspects, the garment may be comprised of a water-resistant or waterproof material. In other aspects, the garment can be comprised of ethylene-vinyl acetate (EVA), poly (ethylene-vinyl acetate) (PEVA), or a copolymer of ethylene and vinyl, or the like.

In various aspects, the garment can be configured and sized to fit all body types and sizes. In further aspects, the garment can be configured to be adjusted to allow room for weight variations and fluctuations. In further aspects, the garment may be sized to correspond with standard sizing associated with undergarments such as briefs, panty, or boyshort. For example, the garment may be sized as xs (petite), s, m, l, xl, 1×, 2×, 3×, and the like.

In one aspect, disclosed herein is a garment for lifting loose skin, the garment comprising at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to at least one portion of a wearer's body; and at least one band first and second opposed ends, each band connected at one or more connection points to at least one portion of a surface of at least one support panel of the plurality of support panels and circumferentially disposed on a plurality of support panels.

In one aspect, disclosed herein is a garment for lifting loose skin, the garment comprising at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to a first portion of a wearer's body; and a plurality of bands, each band having first and second opposed ends, each band connected at one or more connection points to at least one portion of a surface of at least one support panel of the plurality of support panels.

In another aspect, disclosed herein is a garment for lifting loose skin, the garment comprising: a support portion configured to lift and hold a wearer's loose skin, the support portion comprising: at least one tubular support panel, each support panel having an interior surface and exterior surface, a first edge defining a first opening and second edge defining a second opening, the support panel being configured to adjustably secure the support portion to a first portion of a wearer's body; and a top support panel configured to flexibly secure around a portion of the wearer's body, the support panel comprising a clear, elastic-type band configured to roll up a wearer's arm, thereby providing a firm, smooth appearance of the arm.

Also disclosed herein are methods of using the disclosed garments. For example, in another exemplary aspect, the present disclosure provides a method for using a disclosed garment for lifting loose skin. In further aspects, the method comprises the step of using a disclosed garment for lifting loose or saggy skin. The garment may comprise a garment for lifting saggy skin, the garment comprising at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a first portion of a wearer's body.

In further aspects, the method can further comprise at least one of: wearing the garment, stepping into at least one support panel of the garment, pulling an opening of the garment up to a wearer's waist level, securing at least one opening around a portion of the wearer's body, placing a portion of the support portion around the wearer's such that the garment does not move down the user's body, pulling up on a portion of the support portion such that the adjacent skin of the wearer's body that is not covered by the garment is smooth, firm, and or tight; and inserting a hand into at least one garment opening and pulling a portion of skin into the support portion. In still further aspects, the method can further comprise at least one of: securing at least one edge of at least one support panel to at least one portion of the top band to adjust the support level. In yet further aspects, the method can comprise placing an article of clothing directly over the garment.

According to various aspects of the invention, the garments of the present disclosure can comprise multiple configurations. For example, various exemplary embodiments of the inventive skin lifting garments are shown in FIGS. 1A-3B.

Figure 1B:
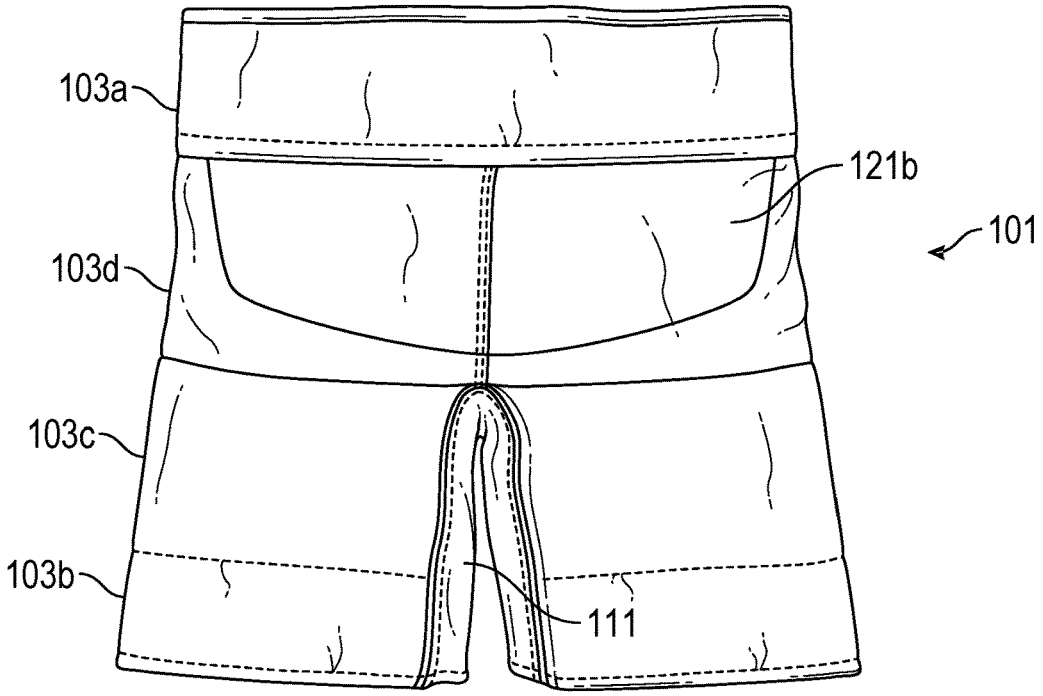

In further aspects, FIGS. 1A and 1B are front and rear perspectives depicting various features and components of an exemplary garment in accordance with the present invention. As shown, garment 100 comprises a garment support portion 101 configured to lift and hold a wearer's loose skin, the garment support portion 101 comprising a plurality of support panels 103, each support panel having an interior surface and exterior surface, a first edge and second edge, the plurality of support panels being configured to adjustably secure the garment support portion to a portion of a wearer's waist and thigh area; and a pair of bands 105, each band having first and second opposed ends, each band connected at a plurality of connection points to various portions of external surfaces of different support panels. As shown, the plurality of support panels comprise top support panel 103*a* configured to flexibly secure around a portion of the wearer's waist, two bottom support panels 103*b* configured to flexibly secure around a first portion of the wearer's thigh, two lower middle support panels 103*c* configured to flexibly secure around a second portion of the wearer's thigh, and an upper middle support panel 103*d* configured to flexibly secure around a portion of the wearer's stomach. A first end of each band 105 is connected to an upper edge of a bottom support panel 103*b* and upper edge of lower middle support panel 103*c*, and a second opposed end of band 105 is connected to top support panel 103*a*. Top support panel 103*a* comprises attachment means 107 in the form of hook and loop fasteners, for example VELCRO, disposed on external surface of top support panel 103*a*, and is configured to detachably connect to second opposed end of band 105 using a corresponding attachment means 107. While two attachment means 107 are shown in the present embodiment, top support panel 103*a* can comprise any number of attachment means 107, such as, for example, three, four, or even across the entire front area. In various aspects, the plurality of attachment means provide a plurality of attachment positions to allow for adjustment of a multiple levels of loose skin support. Depending on the amount of loose or saggy skin pulled into the garment, the band may be connected at different attachment point to provide additional support. For example, if a large amount of loose or saggy skin is pulled into the garment, the band may be connected at higher attachment point to provide additional support for the higher weight of the loose skin. Top support panel 103*a* may comprise a thick elastic material effective to flexibly secure the top opening against a portion of the wearer's waist area, and bottom support panels 103*b* may likewise comprise a thick elastic material effective to flexibly bottom openings secured against the wearer's thigh, as further described herein. Garment 100 may further comprise a gripping area 109 disposed on an inner surface of top support panel 103*a* and/or bottom support panel 103*b*, the gripping area 109 comprising an anti-slip material, such as silicone or high friction rubber. To this end, anti-slip material disposed on gripping area 109 can maintain and enhance skin contact, and thus, retention of loose or saggy skin within the garment. In some aspects, the garment 100 may comprise a relief panel 111 connected to at least one portion of at least one support panel in order to provide breadth and/or reduce stress from a corresponding portion of the wearer's body. In further aspects, relief panel 111 may be in form of a gusset connected to a portion of bottom support panel 103*b* and a portion of lower middle support panel 103*c* to provide breadth and/or reduce stress from a portion of the wearer's crotch area. In some aspects, the garment may comprise stomach support area 121*a* and/or butt support area 121*b*. In other aspects, a support panel, for example upper middle support panel 103*d*, can comprise stomach support area 121*a* and/or butt support area 121*b*. In further aspects, stomach support area 121*a* and/or butt support area 121*b* may be co-extensive with a support panel or may comprise a portion of contact area of a support panel. In still further aspects, stomach support area 121*a* and/or butt support area 121*b* can be configured to provide targeted and guided compression.

Figure 2A:
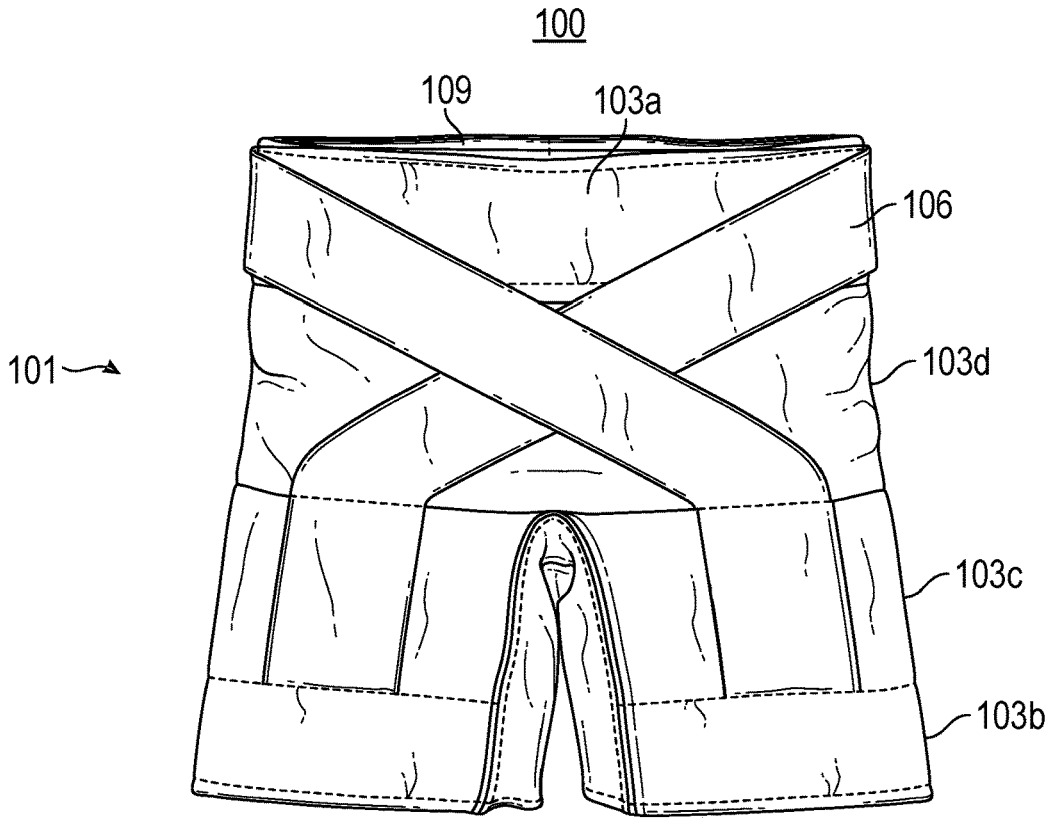
FIGS. 2A-2B show various views depicting a garment in accordance with an exemplary embodiment of the present invention.
Figure 2B:
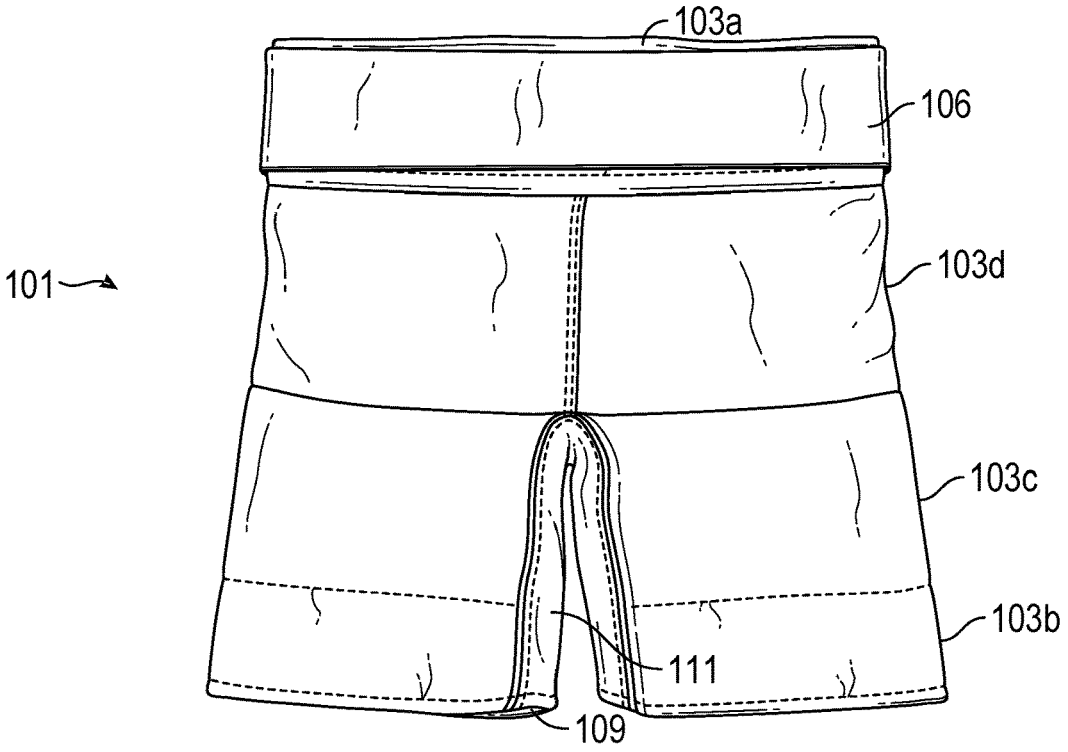

In further aspects, FIGS. 2A and 2B are front and rear perspectives depicting various features and components of another exemplary garment in accordance with the present invention. In this exemplary embodiment, the garment comprises a single band 106 circumferentially disposed on a plurality of support panels. As shown, first end of band 106 is connected to one bottom support panel 103*b* and second opposed end of band 106 is connected to another bottom support panel 103*b*, while middle portion of band 106 is circumferentially disposed on upper middle panel 103*d* and top support panel 103*a*. After connection point at upper edge of first lower support panel 103*c*, band 106 travels diagonally across front surface of upper middle support 103*d* from one side to the opposite side (i.e., from lower left portion to upper right portion), around the rear surface of top support band 103*a* (FIG. 2B), and back diagonally across front surface of upper middle support 103*d* from one side to the opposite side (i.e., from upper left portion to lower right portion) to connection point at upper edge of first lower support panel 103*c*. In some aspects, band 106 is located on a portion of lower middle support 103*c* corresponding to the front of a wearer's thigh. In other aspects, band 106 is located on a portion of lower middle support 103*c* corresponding to the side of a wearer's thigh. In use, band 106 wraps around the wearer's waist area in the back and crosses in an area corresponding to a wearer's abdomen in the front. In various aspects, band 106 may be adjusted to provide the desired level of support for any given weight of loose or saggy skin retained within the garment. For example, if a large amount of loose or saggy skin is pulled into the garment, band 106 may be moved higher up on rear portion of the garment to provide additional support for the higher weight of the loose skin.

Figure 3A:
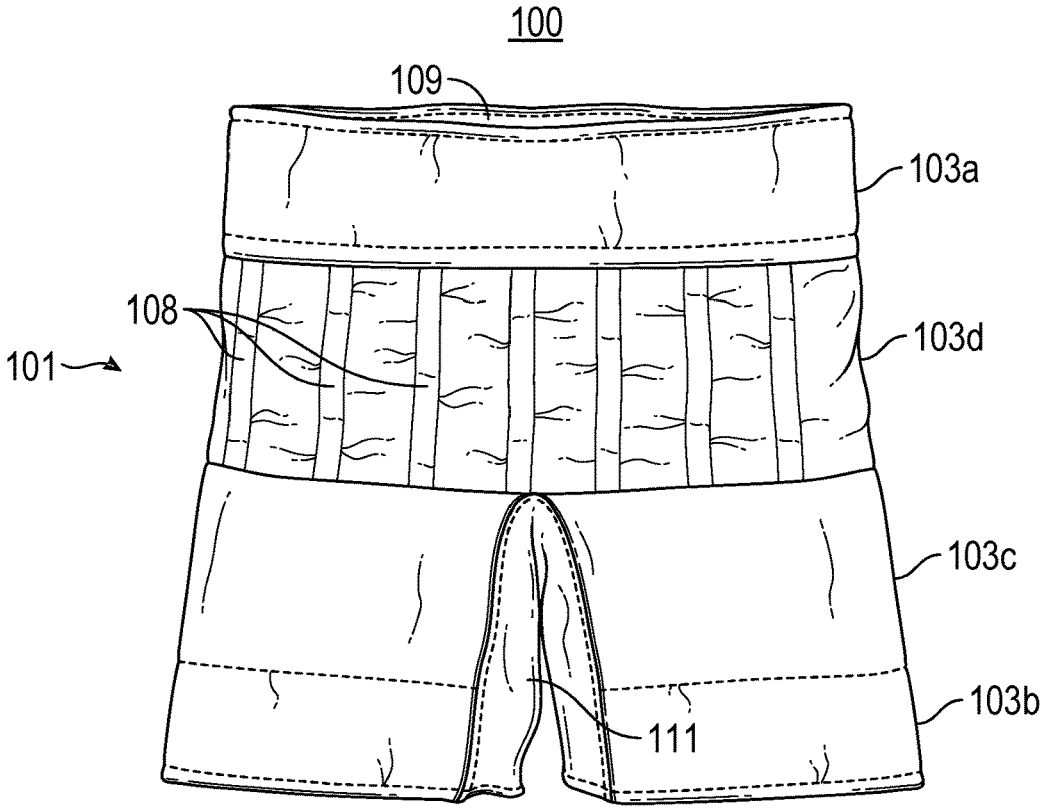
FIGS. 3A-3B show various views depicting a garment in accordance with an exemplary embodiment of the present invention.
Figure 3B:
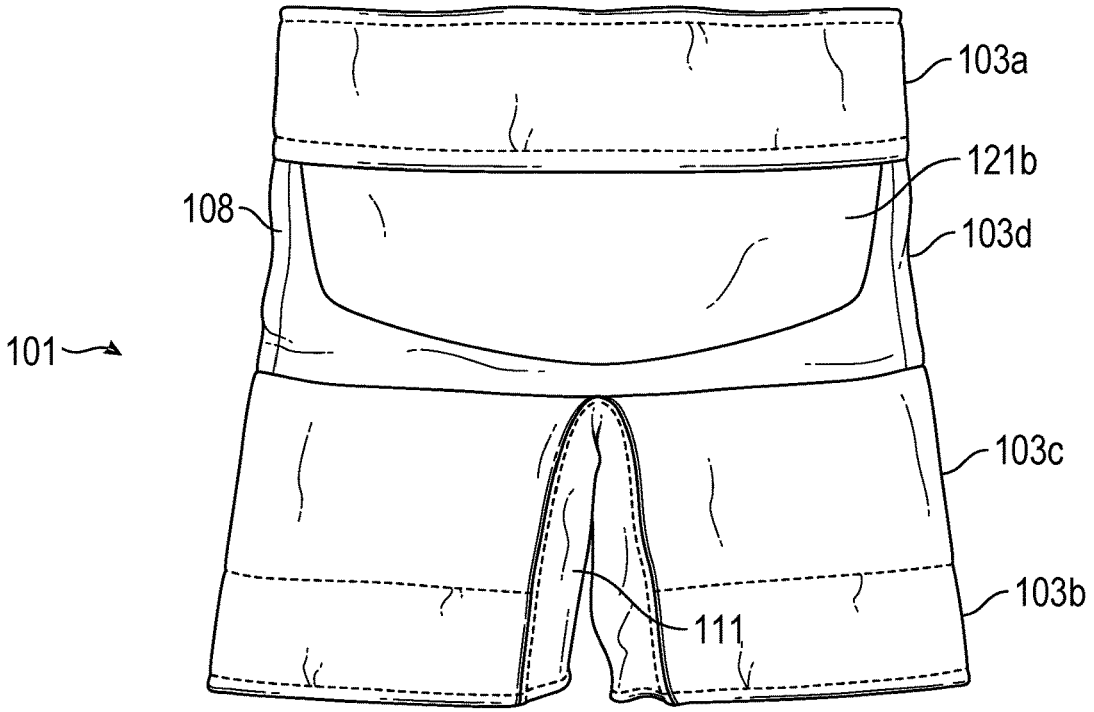

While bands 105 and band 106 are shown dispose on an outer surface of support panels, in some embodiments, the support panels may comprise outer and inner layers, and bands 105 and bands 106 may be disposed between outer and inner layers. In other embodiments, the support panels may comprise integrated bands. FIGS. 3A and 3B are front and rear perspectives depicting various features and components of another exemplary garment in accordance with the present invention. In this exemplary embodiment, the garment comprises an upper middle support panel 103*d* having a plurality of integrated bands 108, and optionally ruching strips. As shown, first ends of integrated bands 108 are attached to an upper edge of lower middle support panel 103*c* and opposed second ends of integrated bands 108 are attached to lower edge of top support panel 103*a*.

According to various aspects, the disclosed garments may provide varying or graduated amounts of compression along a given portion of the wearer body with the maximum amount of compressive force provided at the portion of the body where the loose skin is first pulled up, to a lower or minimum compression force towards the lower stomach or trunk area of the wearer's body. In some aspects, the varying levels of compression may form a compression gradient from maximum to minimum. In other aspects, the varying levels of compression may form alternating compression zones having alternating compression levels. In yet other aspects, the varying levels of compression may form graduated compression zones. For example, the maximum amount of compressive force may be provided at bottom support panel 103*b* corresponding to a lower thigh area or above the knee, where loose or saggy skin may be initially pulled up into the garment. The minimum compression force may be provided at upper middle support panel 103*d* corresponding to lower stomach area, at the waist, or just below the waist the wearer's body. In further aspects, a compression force level between minimum and maximum may be provided at lower middle support panel 103*c* corresponding to an upper thigh area. In some aspects, a support panel may comprise an intra-panel compression gradient, where varying or graduated amounts of compression are provided along a support panel, for example, between a maximum compression level at one support panel edge and a minimum compression level at the opposed support panel edge. When loose skin is pulled into the garment by a wearer, the exposed skin area of the wearer's body remaining outside the garment will have the appearance of firm, smooth and taut skin. In further aspects, the graduated compression zones of the garment allow for even and/or uniform upward distribution of the loose and saggy skin along a compression gradient. While six discrete support panels are shown, the present invention may utilize any number of support panels to provide any number of compression zones among the garment to achieve the desired compression gradient. In some aspects, the compressive force and force graduation can be achieved by varying material type and/or the material thickness of the material in each support panel and/or compression zone. In some aspects, different compression zones within a support panel may have different thicknesses and/or materials. In other aspects, the graduation in compressive force can be achieved by varying the type or composition of the material for each compression zone. For example, lower middle support panel 103*c* may comprise a material containing spandex (e.g., from about 10% to about 12% spandex, or higher) to provide a higher compression level effective to hold skin taut, pushing loose skin upwards into upper middle support panel 103*d*, which may comprise a material containing nylon (e.g., from about 88% to about 90% nylon) to provide a lower compression level effective to evenly distribute loose skin within this support panel section. As described herein, the disclosed garments can also comprise various options for use in articles of clothing having integrated support panels for lifting and holding loose and/or saggy skin. For example, the disclosed garments may be connected or attached to an inner surface of an outer garment body, for example, a skirt or shorts. In this aspect, the outer garment body covers and conceals the garment support portion underneath when donned by a wearer.

The present invention includes at least the following aspects: Aspect 1: A garment for lifting loose and/or saggy skin, the garment comprising at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a first portion of a wearer's body.

Aspect 2: The garment of aspect 1, further comprising at least one band first and second opposed ends, each band attached or connected at one or more connection points to at least one portion of a surface of at least one support panel of the plurality of support panels.

Aspect 3: The garment of any preceding aspect, wherein the at least one band is connected to an exterior surface of at least one support panel of the plurality of support panels.

Aspect 4: The garment of any preceding aspect, wherein the at least one band is connected to an interior surface of at least one support panel of the plurality of support panels.

Aspect 5: The garment of any preceding aspect, wherein at least one support panel of the plurality of support panels comprises a top support panel configured to flexibly secure around a second portion of the wearer's body.

Aspect 6: The garment of any preceding aspect, wherein at least one support panel of the plurality of support panels comprises a bottom support panel configured to flexibly secure around a third portion of the wearer's body.

Aspect 7: The garment of any preceding aspect, wherein at least one support panel of the plurality of support panels comprises a middle support panel configured to flexibly secure around a fourth portion of the wearer's body.

Aspect 8: The garment of any preceding aspect, wherein at least one support panel of the plurality of support panels comprises a middle support panel configured to flexibly secure around a fifth portion of the wearer's body.

Aspect 9: The garment of any preceding aspect, wherein at least one support panel of the plurality of support panels comprises a first middle support panel configured to flexibly secure around a fourth portion of the wearer's body, and wherein at least one support panel of the plurality of support panels comprises a second middle support panel configured to flexibly secure around a fifth portion of the wearer's body.

Aspect 10: The garment of any preceding aspect, wherein at least one support panel of the plurality of support panels comprises a top support panel configured to flexibly secure around a portion of the wearer's waist.

Aspect 11: The garment of any preceding aspect, wherein at least one support panel of the plurality of support panels comprises a bottom support panel configured to flexibly secure around a first portion of the wearer's thigh.

Aspect 12: The garment of any preceding aspect, wherein the plurality of support panels comprise a first bottom support panel configured to flexibly secure around a first portion of the wearer's first thigh and a second bottom support panel configured to flexibly secure around a first portion of the wearer's second thigh.

Aspect 13: The garment of any preceding aspect, wherein at least one support panel of the plurality of support panels comprises at least one middle support panel configured to flexibly secure around a second portion of the wearer's thigh.

Aspect 14: The garment of any preceding aspect, wherein at least one support panel of the plurality of support panels comprises at least one middle support panel configured to flexibly secure around a portion of the wearer's stomach.

Aspect 15: The garment of any preceding aspect, wherein the plurality of support panels comprise at least one lower middle support panel configured to flexibly secure around a portion of the wearer's upper thigh, and at least one upper middle support panel configured to flexibly secure around a portion of the wearer's stomach.

Aspect 16: The garment of any preceding aspect, wherein the plurality of support panels comprise first and second lower middle support panel configured to flexibly secure around portions of the wearer's first and second upper thighs respectively, and at least one upper middle support panel configured to flexibly secure around a portion of the wearer's stomach.

Aspect 17: The garment of any preceding aspect, wherein the top support panel is connected or attached to at least one other support panel.

Aspect 18: The garment of any preceding aspect, wherein a first edge of at least one support panel and a second edge of a top support panel are connected or attached.

Aspect 19: The garment of any preceding aspect, further comprising a plurality of bands.

Aspect 20: The garment of any preceding aspect, wherein at least one end of a band is attached or connected to at least one support panel.

Aspect 21: The garment of any preceding aspect, wherein a first end and a second end of the band are attached or connected to different support panels.

Aspect 22: The garment of any preceding aspect, wherein a first end, a second end, and middle portion of the band are attached or connected to different support panels.

Aspect 23: The garment of any preceding aspect, wherein a first end of the band is attached or connected to at least one support panel, and a second opposed end of the band is attached or connected to at least one other support panel.

Aspect 24: The garment of any preceding aspect, wherein a first end of the band is attached or connected to a first support panel, a second opposed end of the band is attached or connected to a second support panel, and middle portion of the band is attached or connected to a third support panel.

Aspect 25: The garment of any preceding aspect, wherein the at least one band is circumferentially disposed on a plurality of support panels.

Aspect 26: The garment of any preceding aspect, wherein the at least one band is circumferentially disposed on a top support panel and a middle support panel.

Aspect 27: The garment of any preceding aspect, wherein the at least one band is circumferentially disposed on a top support panel and an upper middle support panel.

Aspect 28: The garment of any preceding aspect, wherein at least one support panel of the plurality of support panels comprises at least one of an outer panel having an interior surface and exterior surface, or an inner panel having an interior surface and exterior surface.

Aspect 29: The garment of any preceding aspect, wherein at least one support panel of the plurality of support panels comprises an outer panel having an interior surface and exterior surface and an inner panel having an interior surface and exterior surface.

Aspect 30: The garment of any preceding aspect, wherein at least one support panel of the plurality of support panels comprises at least one of an outer layer having an interior surface and exterior surface, or an inner layer having an interior surface and exterior surface.

Aspect 31: The garment of any preceding aspect, wherein at least one support panel of the plurality of support panels comprises an outer layer having an interior surface and exterior surface and an inner layer having an interior surface and exterior surface.

Aspect 32: The garment of any preceding aspect, wherein at least one band is disposed between an outer panel and inner panel of at least one support panel.

Aspect 33: The garment of any preceding aspect, wherein at least one band is disposed between an outer panel and inner panel of a plurality of support panels.

Aspect 34: The garment of any preceding aspect, wherein at least one band is disposed between an outer layer and inner layer of at least one support panel.

Aspect 35: The garment of any preceding aspect, wherein at least one band is disposed between an outer layer and inner layer of a plurality of support panels.

Aspect 36: The garment of any preceding aspect, wherein the band is comprised of an elastic material configured to be flexibly secured against a portion of a wearer's body.

Aspect 37: The garment of any preceding aspect, wherein the top support panel is comprised of an elastic or silicone material configured to flexibly secure an opening of the garment against a portion of a wearer's body.

Aspect 38: The garment of any preceding aspect, wherein at least one support panel defines an outermost opening and/or edge of the garment.

Aspect 39: The garment of any preceding aspect, wherein a top support panel defines an outermost opening and/or edge of the garment.

Aspect 40: The garment of any preceding aspect, wherein a bottom support panel defines an outermost opening and/or edge of the garment.

Aspect 41: The garment of any preceding aspect, wherein the top support panel defines a first outermost opening and/or edge of the garment, and wherein a bottom support panel defines an opposed, second outermost opening and/or edge of the garment.

Aspect 42: The garment of any preceding aspect, wherein an outer panel and inner panel may be integrated and/or comprise a one or two-ply construction.

Aspect 43: The garment of any preceding aspect, wherein an outer panel and inner panel may be integrated and/or comprise a two-ply construction in the portions where they attached or overlap.

Aspect 44: The garment of any preceding aspect, wherein an outer layer and inner layer may be integrated and/or comprise a two-ply construction.

Aspect 45: The garment of any preceding aspect, wherein an outer layer and inner layer may be integrated and/or comprise a two-ply construction in the portions where they attached or overlap.

Aspect 46: The garment of any preceding aspect, further comprising at least one relief panel configured to provide breadth and/or reduce stress from at least one portion of the garment.

Aspect 47: The garment of any preceding aspect, wherein at least one relief panel is connected to at least one portion of at least one support panel, and wherein the at least one relief panel is configured to provide breadth and/or reduce stress from at least one portion of the wearer's body.

Aspect 48: The garment of any preceding aspect, wherein at least one relief panel is connected to at least one portion of at least one support panel, and wherein the at least one relief panel is configured to provide breadth and/or reduce stress from a corresponding portion of the wearer's body the at least one support panel is configured to secure against.

Aspect 49: The garment of any preceding aspect, wherein at least one relief panel is connected to at least one portion of at least one bottom support panel, and wherein the at least one relief panel is configured to provide breadth and/or reduce stress from a portion of the wearer's crotch area.

Aspect 50: The garment of any preceding aspect, wherein at least one relief panel is connected to at least one portion of at least one middle support panel, and wherein the at least one relief panel is configured to provide breadth and/or reduce stress from a portion of the wearer's crotch area.

Aspect 51: The garment of any preceding aspect, wherein at least one relief panel is connected to at least one portion of at least one middle support panel and one bottom support panel, and wherein the at least one relief panel is configured to provide breadth and/or reduce stress from a portion of the wearer's crotch area.

Aspect 52: The garment of any preceding aspect, wherein at least one relief panel is configured to provide from about 0.1 to about 1.1 inches additional breadth.

Aspect 53: The garment of any preceding aspect, wherein at least one relief panel is configured to provide from about 1.0 to about 5.0 inches additional breadth.

Aspect 54: The garment of any preceding aspect, further comprising at least one attachment means configured to detachably connect one or more garment portions or components.

Aspect 55: The garment of any preceding aspect, wherein an attachment means is disposed on one more portions of a surface of at least one support panel.

Aspect 56: The garment of any preceding aspect, wherein an attachment means is disposed on one more ends of at least one band.

Aspect 57: The garment of any preceding aspect, wherein at least one support panel comprises a plurality of attachment means configured to detachably connect to one or more support panels using one or more bands; and wherein the plurality of attachment means comprise a plurality of attachment positions configured to allow for adjustment of a predetermined level of loose skin support.

Aspect 58: The garment of any preceding aspect, wherein the top support panel comprises a plurality of attachment means configured to detachably connect to one or more support panels using one or more bands; and wherein the plurality of attachment means comprise a plurality of attachment positions configured to allow for adjustment of a predetermined level of loose skin support.

Aspect 59: The garment of any preceding aspect, wherein the top support panel comprises a plurality of attachment means configured to detachably connect to a plurality of other support panels using a plurality of bands; and wherein the plurality of attachment means comprise a plurality of attachment positions configured to allow for adjustment of a predetermined level of loose skin support.

Aspect 60: The garment of any preceding aspect, wherein the top support panel comprises a plurality of attachment means configured to detachably connect to first and second bottom support panels using first and second bands; and wherein the first band is configured to connect to the first bottom support panel and the second band is configured to connect to the second bottom support panel.

Aspect 61: The garment of any preceding aspect, wherein the top support panel comprises a plurality of attachment means configured to detachably connect to first and second middle support panels using first and second bands; and wherein the first band is configured to connect to the first middle support panel and the second band is configured to connect to the second middle support panel.

Aspect 62: The garment of any preceding aspect, wherein the attachment means comprises at least one of hook and loop fasteners, buttons, hooks, snaps, fasteners, ruching strips, silicone, or a combination thereof.

Aspect 63: The garment of any preceding aspect, further comprising a gripping area on at least one surface of at least one support panel.

Aspect 64: The garment of any preceding aspect, further comprising a gripping area on an inner surface of at least one support panel.

Aspect 65: The garment of any preceding aspect, further comprising a gripping area disposed on an inner surface of at least one of a top support panel or bottom support panel.

Aspect 66: The garment of any preceding aspect, wherein the gripping area comprising an anti-slip material.

Aspect 67: The garment of any preceding aspect, wherein the gripping area comprises a portion or all of the inner surface of the support panel.

Aspect 68: The garment of any preceding aspect, wherein the anti-slip material is disposed on a portion or all of a surface of the gripping area.

Aspect 69: The garment of any preceding aspect, wherein the anti-slip material comprises at least one of silicone, thermoplastic elastomers (TPEs), high-friction rubber, vinyl, or the like.

Aspect 70: The garment of any preceding aspect, wherein the garment is configured to slide on and off like standard undergarments.

Aspect 71: The garment of any preceding aspect, wherein at least one support panel further comprises one or more elastic bands or reinforced bands, and/or silicone, or the like.

Aspect 72: The garment of any preceding aspect, wherein a top support panel further comprises a reinforced band.

Aspect 73: The garment of any preceding aspect, wherein a bottom support panel further comprises a reinforced band.

Aspect 74: The garment of any preceding aspect, wherein the garment is constructed as a one-piece undergarment and configured to hold up loose and/or saggy skin on the upper and back thighs.

Aspect 75: The garment of any preceding aspect, wherein the garment comprise a clear, elastic-type band configured to roll up a wearer's arm, thereby providing a firm, smooth appearance of the arm; or wherein the garment is implemented into a shirt comprising comprise a clear, elastic-type band configured to roll up a wearer's arm, thereby providing a firm, smooth appearance of the arm.

Aspect 76: The garment of any preceding aspect, wherein the garment is configured to be able to worn under short-sleeve dresses and shirts.

Aspect 77: The garment of any preceding aspect, wherein the support panel comprises a soft, breathable material.

Aspect 78: The garment of any preceding aspect, wherein the material comprises at least one of latex, LYCRA, silicone, spandex, hook and loop fastener, ruching strips, nylon, elastane, polyester, lace, silk and/or cotton, or a combination thereof.

Aspect 79: The garment of any preceding aspect, wherein the material comprises at least one of a woven fabric, non-woven fabric, natural fabric, synthetic fabric, or combinations thereof.

Aspect 80: The garment of any preceding aspect, wherein the garment is configured to fit men and women.

Aspect 81: The garment of any preceding aspect, wherein the garment is unisex.

Aspect 82: The garment of any preceding aspect, further comprising an outer garment body configured to connect to the support portion.

Aspect 83: The garment of any preceding aspect, wherein an inner surface of the outer garment body is configured to connect to an outer surface of the support portion.

Aspect 84: The garment of any preceding aspect, wherein the outer garment body comprises an article of clothing.

Aspect 85: The garment of any preceding aspect, wherein the outer garment body comprises an article of clothing selected from a skirt, shorts, pants, legging, sleeve, shirt, and jacket.

Aspect 86: A method for lifting loose and/or saggy skin, the method comprising the steps of: a) providing a disclosed garment of any preceding aspect to lift a portion of a wearer's skin; and b) using the garment to lift a portion of the wearer's skin.

Aspect 87: The method of any preceding aspect, wherein the step of using comprises at least one of: wearing the garment, securing at least one support panel against a portion of the wearer's body, stepping into at least one support panel of the garment, pulling an opening of the garment up to a wearer's waist level, securing at least one opening around a portion of the wearer's body, placing the support portion around the wearer's such that the garment does not move down the wearer's body, pulling up on a portion of the support portion such that the adjacent skin of the wearer's body that is not covered by the garment is smooth, firm, and or taut; and inserting a hand into at least one garment opening and pulling a portion of skin into the support portion.

Aspect 88: The method of any preceding aspect, further comprising at least one of: securing at least one end of at least one band to at least one portion of a top support panel to adjust a level of loose skin support.

Aspect 89: The method of any preceding aspect, further comprising placing an article of clothing directly over the garment.

Aspect 90: A garment for lifting saggy skin, the garment comprising: at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to at least one portion of a wearer's body; and at least one band first and second opposed ends, each band connected at one or more connection points to at least one portion of a surface of at least one support panel of the plurality of support panels; wherein the plurality of support panels comprise a top support panel configured to flexibly secure around a portion of the wearer's waist, a plurality of bottom support panels configured to flexibly secure around a first portion of the wearer's thigh, a plurality of lower middle support panels configured to flexibly secure around a second portion of the wearer's thigh, and an upper middle support panel configured to flexibly secure around a portion of the wearer's stomach; and wherein a first end of the at least one band is connected to a first bottom support panel, a second opposed end of the at least one band is connected to a second bottom support panel, and a middle portion of the at least one band is circumferentially disposed on the top support panel and upper middle panel.

Aspect 91: A garment for lifting loose skin, the garment comprising: at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to a first portion of a wearer's body; and a plurality of bands, each band having first and second opposed ends, each band connected at one or more connection points to at least one portion of a surface of at least one support panel of the plurality of support panels; wherein the plurality of support panels comprise a top support panel configured to flexibly secure around a portion of the wearer's waist, a plurality of bottom support panels configured to flexibly secure around a first portion of the wearer's thigh, a plurality of lower middle support panels configured to flexibly secure around a second portion of the wearer's thigh, and an upper middle support panel configured to flexibly secure around a portion of the wearer's stomach; and wherein a first end of the at least one band is connected to a first bottom support panel, a second opposed end of the band is connected to a second bottom support panel, and middle portion of the band is connected to at least one lower middle support panel; and wherein the top support panel comprises a plurality of attachment means configured to detachably connect to first and second bottom support panels using first and second bands, the first band being configured to connect to the first bottom support panel and the second band being configured to connect to the second bottom support panel; and wherein the plurality of attachment means comprise a plurality of attachment positions configured to allow for adjustment of a predetermined level of loose skin support.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A garment for lifting saggy skin, the garment comprising:

at least one garment support portion configured to lift and hold a wearer's loose skin, the garment support portion comprising a plurality of support panels, each support panel having an interior surface and exterior surface, a first edge and second edge, the plurality of support panels being configured to adjustably secure the garment support portion to a first portion of a wearer's body; and at least one band having first and second opposed ends, each band attached or connected at one or more connection points to at least one portion of a surface of a plurality of support panels;

wherein the plurality of support panels comprises a top support panel configured to flexibly secure around a portion of the wearer's waist, a first bottom support panel configured to flexibly secure around a first portion of the wearer's first thigh, a second bottom support panel configured to flexibly secure around a first portion of the wearer's second thigh, and at least one middle support panel configured to flexibly secure around a second portion of the wearer's thigh; and wherein a first end of the at least one band is connected to a first bottom support panel and a second opposed end of said band is fixedly attached to a lower edge of the top support panel.

2. The garment of claim 1, wherein the at least one middle support panel comprises at least one lower middle support panel configured to flexibly secure around a portion of the wearer's upper thigh, and at least one upper middle support panel configured to flexibly secure around a portion of the wearer's stomach.

3. The garment of claim 1, wherein the top support panel defines a first edge of the garment corresponding to a first outermost opening; and wherein a bottom support panel defines an opposed, second edge of the garment corresponding to a second outermost opening of the garment.

4. The garment of claim 3, wherein a middle portion of the at least one band is connected to or disposed on a surface of a third support panel.

5. The garment of claim 2, wherein a middle portion of the at least one band is circumferentially disposed on a surface of the least one lower middle support panel and the at least one upper middle support panel.

6. The garment of claim 1, further comprising a plurality of bands, wherein a first end of a first band of the plurality of bands is connected to a first bottom support panel and a second opposed end of the first band is connected to a first portion of the lower edge of the top support panel; and wherein a first end of a second band of the plurality of bands is connected to a second bottom support panel and a second opposed end of the second band is connected to a second portion of the lower edge of the top support panel.

7. The garment of claim 3, further comprising at least one relief panel connected to at least one portion of at least one middle support panel and one bottom support panel, wherein the at least one relief panel is configured to provide breadth to a corresponding portion of the wearer's body; and wherein the at least one relief panel is configured to provide from about 0.5 to about 5 inches additional breadth.

8. The garment of claim 1, further comprising at least one relief panel connected to at least one portion of at least one middle support panel and one bottom support panel, wherein the at least one relief panel is configured to provide breadth to a corresponding portion of the wearer's body.

9. The garment of any claim 8, wherein the top support panel comprises a plurality of attachment means configured to detachably connect to first and second bottom support panels using first and second bands; and wherein the first band is configured to connect to the first bottom support panel and the second band is configured to connect to the second bottom support panel.

10. The garment of claim 9, wherein the attachment means comprises one or more of hook and loop fasteners, buttons, hooks, snaps, fasteners, and ruching strips.

11. The garment of claim 4, further comprising a gripping area disposed on an inner surface of at least one of a top support panel or bottom support panel, wherein the gripping area comprising an anti-slip material.

12. The garment of claim 11, wherein the plurality of support panels are comprised of a plurality of materials configured to provide a plurality of predetermined compression levels.

13. A garment for lifting saggy skin, the garment comprising:

at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to at least one portion of a wearer's body; and at least one band first and second opposed ends, each band connected at one or more connection points to at least one portion of a surface of at least one support panel of the plurality of support panels;

wherein the plurality of support panels comprise a top support panel configured to flexibly secure around a portion of the wearer's waist, a plurality of bottom support panels configured to flexibly secure around a first portion of the wearer's thigh, a plurality of lower middle support panels configured to flexibly secure around a second portion of the wearer's thigh, and a rear middle support panel configured to flexibly secure around a portion of the wearer's butt; and wherein a first end of the at least one band is connected to a first bottom support panel, a second opposed end of the at least one band is connected to a second bottom support panel, and a middle portion of the at least one band is circumferentially disposed on the top support panel and upper middle panel.

14. A garment for lifting saggy skin, the garment comprising:

at least one garment body support portion configured to lift and hold a wearer's loose skin, the garment body support portion comprising a plurality of support panels, each support panel having an interior surface and exterior surface, a first edge and second edge, the plurality of support panels being configured to adjustably secure the garment body support portion to a first portion of a wearer's body; and a plurality of bands, each band having first and second opposed ends, each band connected at one or more connection points to at least one portion of a surface of at least one support panel of the plurality of support panels;

wherein the plurality of support panels comprise a top support panel configured to flexibly secure around a portion of the wearer's waist, a plurality of bottom support panels configured to flexibly secure around a first portion of the wearer's thigh, at least one middle support panel configured to flexibly secure around a second portion of the wearer's thigh, an upper middle support panel configured to flexibly secure around a portion of the wearer's stomach, and a rear upper middle support panel configured to flexibly secure around a portion of the wearer's butt; and wherein a first end of the at least one band is connected to a first bottom support panel, a second opposed end of the band is connected to a second bottom support panel, and middle portion of the band is connected to at least one lower middle support panel; and wherein the top support panel comprises a plurality of attachment means configured to detachably connect to first and second bottom support panels using first and second bands, the first band being configured to connect to the first bottom support panel and the second band being configured to connect to the second bottom support panel; and wherein the plurality of attachment means comprise a plurality of attachment positions configured to allow for adjustment of a predetermined level of loose skin support.

15. A method for lifting saggy skin, the method comprising the steps of:

providing the garment of claim 1 to lift a portion of a wearer's skin; and using the garment to lift a portion of the wearer's skin.

16. The garment of claim 6, wherein the plurality of bands are integrated with the at least one middle support panel.

17. The garment of claim 1, further comprising a plurality of bands and a plurality of middle support panels.

18. The garment of claim 17, wherein the plurality of bands are integrated between middle support panels.

19. The garment of claim 14, wherein the plurality of support panels are integrated.

20. The garment of claim 12, wherein the plurality of materials comprise two or more of latex, silicone, spandex, hook and loop fastener, ruching strips, nylon, elastane, polyester, lace, silk, and cotton.

* * * * *